US012245651B2

(12) United States Patent
Djelaj

(10) Patent No.: US 12,245,651 B2
(45) Date of Patent: Mar. 11, 2025

(54) HAIR EXTENSION INSTALLATION METHOD

(71) Applicant: Muse Hairpro LLC, Washington Township, MI (US)

(72) Inventor: Natasha Djelaj, Washington Township, MI (US)

(73) Assignee: Muse Hairpro LLC, Washington Township, MI (US)

( * ) Notice: Subject to any disclaimer, the term of this patent is extended or adjusted under 35 U.S.C. 154(b) by 300 days.

(21) Appl. No.: 17/875,595

(22) Filed: Jul. 28, 2022

(65) Prior Publication Data

US 2023/0032189 A1 Feb. 2, 2023

Related U.S. Application Data

(60) Provisional application No. 63/226,227, filed on Jul. 28, 2021.

(51) Int. Cl.
*A41G 5/00* (2006.01)

(52) U.S. Cl.
CPC ..... *A41G 5/006* (2013.01); *A41G 5/0073* (2013.01)

(58) Field of Classification Search
CPC ..... A41G 5/00; A41G 5/0006; A41G 5/002; A41G 5/0026; A41G 5/006; A41G 5/0013; A41G 5/004; A41G 5/0046; A41G 5/0053; A41G 5/0066; A41G 5/0073; A41G 5/0086; A41G 5/0093; A41G 3/00; A41G 3/0008; A41G 3/0033; A41G 3/0041; A41G 3/0066; A41G 3/0075

See application file for complete search history.

(56) References Cited

U.S. PATENT DOCUMENTS

| | | | | |
|---|---|---|---|---|
| 3,654,935 | A | 4/1972 | Brown | |
| 3,777,768 | A | 12/1973 | Scigliano | |
| 5,121,761 | A | 6/1992 | Meister | |
| 7,252,093 | B2 | 8/2007 | Rodriguez | |
| 7,753,057 | B2 | 7/2010 | Kallabat et al. | |
| 7,861,729 | B2 | 1/2011 | Zephyr et al. | |
| 9,596,898 | B2 | 3/2017 | Seawright | |
| 11,419,375 | B2 * | 8/2022 | Rangel | A41G 5/006 |
| 11,419,376 | B2 * | 8/2022 | Turley | A41G 5/0073 |
| 11,596,191 | B1 * | 3/2023 | Fazal | A41G 5/006 |

(Continued)

FOREIGN PATENT DOCUMENTS

CZ 33297 U1 10/2019

OTHER PUBLICATIONS https://thehairstandard.com/blog/criss-cross-beaded-weft-extensions-tutorial (Year: 2021).*

(Continued)

*Primary Examiner* — Rachel R Steitz
*Assistant Examiner* — Karim Asqiriba
(74) *Attorney, Agent, or Firm* — The Dobrusin Law Firm, PC

(57) ABSTRACT

A method for installing hair extensions where the stitching begins at the back of the head. The method includes parting the hair into a horseshoe or other shape, positioning a weft along the part, placing beads on that section of hair using a thread, and stitching from a portion located in the middle of the head and away from the end of the weft. The stitching then moves outwards towards the direction of the user's face in both directions.

6 Claims, 2 Drawing Sheets

(56) References Cited

U.S. PATENT DOCUMENTS

| | | | | |
|---|---|---|---|---|
| 2005/0051186 | A1* | 3/2005 | Smith | A41G 3/00 132/54 |
| 2006/0060212 | A1* | 3/2006 | Rodriguez | A41G 5/0046 132/201 |
| 2008/0236605 | A1* | 10/2008 | Russo | A41G 5/0066 132/201 |
| 2011/0197908 | A1* | 8/2011 | Waters | A41G 5/0086 132/201 |
| 2014/0060566 | A1* | 3/2014 | Walker | A41G 5/0073 132/201 |
| 2014/0338689 | A1* | 11/2014 | Shuttleworth | A41G 5/0066 132/201 |
| 2019/0357614 | A1* | 11/2019 | Rangel | A41G 5/006 |
| 2020/0113262 | A1* | 4/2020 | Tokko | A41G 5/0066 |
| 2020/0260810 | A1* | 8/2020 | Tokko | A41G 5/0073 |
| 2021/0059337 | A1* | 3/2021 | Turley | A41G 5/0073 |
| 2021/0227910 | A1* | 7/2021 | Sawyer | A41G 5/0086 |
| 2022/0030999 | A1* | 2/2022 | Mizrahi | A41G 5/0073 |
| 2022/0295928 | A1* | 9/2022 | Smith | A41G 5/0046 |
| 2022/0386725 | A1* | 12/2022 | Turley | A41G 5/0073 |
| 2023/0210207 | A1* | 7/2023 | Breci | A41G 5/006 132/201 |

OTHER PUBLICATIONS https://www.youtube.com/watch?v=bRdZ9SkgUDQ, Full Weft Extensions Installation Tutorial (2021).

* cited by examiner

HAIR EXTENSION INSTALLATION METHOD

CROSS REFERENCE TO RELATED APPLICATIONS

This application claims priority and benefit to Provisional Patent Application Ser. No. 63/226,227filed on Jul. 28, 2021.

TECHNICAL FIELD

The present specification generally relates to installation of hair extensions and, more specifically, to a method of stitching to install hair extensions.

BACKGROUND

Hair extensions have been in use for many years to increase volume and/or length of hair. Hair extensions are also used enhance the overall appearance of hair, both by length and color. While many methods of hair extension installation exist, a common method involves attaching or anchoring the extensions to a person's head or natural hair using a horizontal braided section or similar anchoring base. With this method, the extension must be sewn to the braided section or similar anchoring base using a needle and thread. A common method involves stitching a weft or plurality of wefts into a user's existing hair. A common method involves the steps of parting the user's hair into a horseshoe shape, placing beads (consecutively or in any pattern) on sections of hair, and stitching the line of wefts from the left side of the head to the right side (or vice versa). FIG. 1 illustrates the prior art and the corresponding problems. After beads are placed, wefts of hair are placed above and below the beads are sandwiched and not exposed-then the stitching begins. Using this method, problems indicated at reference numeral 100 develop. These issues include tension bald spots, and sores on the side that the stitching begins. Another issue is the lifting of the weft corners from the side that the stitching begins.

Other prior known methods of installation are also known. The video as shown by "the hair standard) (https://thehairstandard.com/blog/criss-cross-beaded-weft-extensions-tutorial/) shows installation of a weft, but it doesn't use any separate thread. While it does start in the middle, no thread is used and thus the installation is not secure. In this method, the installer starts pins in a middle section, for the sole purpose of centering the weft. The installer does NOT continue to weave from a center section towards the users face.

U.S. Pat. No. 7,252,093 discloses a hair extension method. The method comprising gathering a first group of original hair, the first group of original hair being proximate to the portion of the scalp determined to be the location for attaching the extension hair; inserting a portion of the first group of original hair in a first band; providing a first group of artificial support material; inserting a portion of the first group of the artificial support material in the first band, the combination of the first group of original hair and the first group of artificial support material forming a first hair combination; gathering a second group of original hair, the second group of original hair being substantially proximate to the first hair combination; inserting in a second band the combination of at least one hair from the second group of original hair and a portion of the first hair combination, the hairs in between the first and the second band defining a hair track; and attaching the extension hair to the hair track.

While this patent does disclose finding a center portion, the patent does NOT disclose starting the weave at a center or middle portion between the user's ears and finishing two separate weave sections near the user's face.

U.S. Pat. No. 9,595,898 discloses a brainless apparatus and method of combining natural and artificial hair. The method includes parting the person's natural hair so as to form a plurality of adjacent hair root sections forming a starter knot about a starter root section by looping the thread pair about the starter root section using the sew-in needle. A foundation is created laterally across a person's head along the part line by repeatedly looping the thread pair around respective hair root sections between the starter and ending root sections. Then, the wefted hair extension is sewn to the foundation track using the sew-in needle and the thread pair so as to form a combination of natural and artificial hair extending from the person's head. As with the prior references, the patent does NOT disclose starting the weave at a center or middle portion between the user's ears and finishing two separate weave sections near the user's face.

Accordingly, there exists a need in the art to provide an improved hair extension stitching method overcoming the aforementioned disadvantages.

SUMMARY

A weft hair extension installation method on a user, the method including the steps of sectioning the user's hair to form a part, positioning the weft along the part, securing beads on sections of hair to secure the weft to the user's hair, locating a middle portion spaced at least slightly apart from the end of the weft at the back of the user's head, the middle portion being any position located between the distal ends of the weft, but spaced apart from the distal ends at least ½ of an inch, or at least behind the first end bead by the user's face, starting a first stitching section beginning at the back of the head and moving towards the user's face, and starting a second stitching section at the same location as the first and moving toward the other side of the user's face, wherein by starting at a middle portion reduces lifting of the weft on user, reduces sore spots, and creates an increased connection of the weft to the user's hair. In some embodiments, the weft lays flat where the stitching ends. In other embodiments, the beads are made from silicone or other similar material. In some embodiments, the thread is made of cotton, cotton blend, polyester, polyester blend, plastic, plastic-like, or other similar material. In other embodiments, the stitching section uses the thickest and least sensitive hair from the back of the head.

A weft hair extension installation method as shown and described herein including the steps of locating any middle portion of the user's head after the hair is parted and a weft is placed, starting a first stitching section from the back of the user's head and moving towards their face, and starting a second stitching section at the same location as the first and moving towards the other side of the of the user's face.

A weft hair extension installation method on a user, the method including the steps of sectioning the user's hair to form a part, positioning the weft along the part, securing beads on sections of hair to secure the weft to the user's hair, cutting the weft into sections, sewing each weft to the user's head starting at a position located farthest from the user's face, starting a first stitching section beginning at the back of the head and moving towards the user's face, and starting a second stitching section at the same location as the first and moving toward the other side of the user's face wherein by starting at a middle portion reduces lifting of the weft on user, reduces sore spots, and creates an increased connection of the weft to the user's hair.

BRIEF DESCRIPTION OF THE DRAWINGS

The embodiments set forth in the drawings are illustrative and exemplary in nature and not intended to limit the subject matter. The following detailed description of the illustrative embodiments can be understood when read in conjunction with the following drawings, where like structure is indicated with like reference numerals and in which.

DETAILED DESCRIPTION

Figure 1:
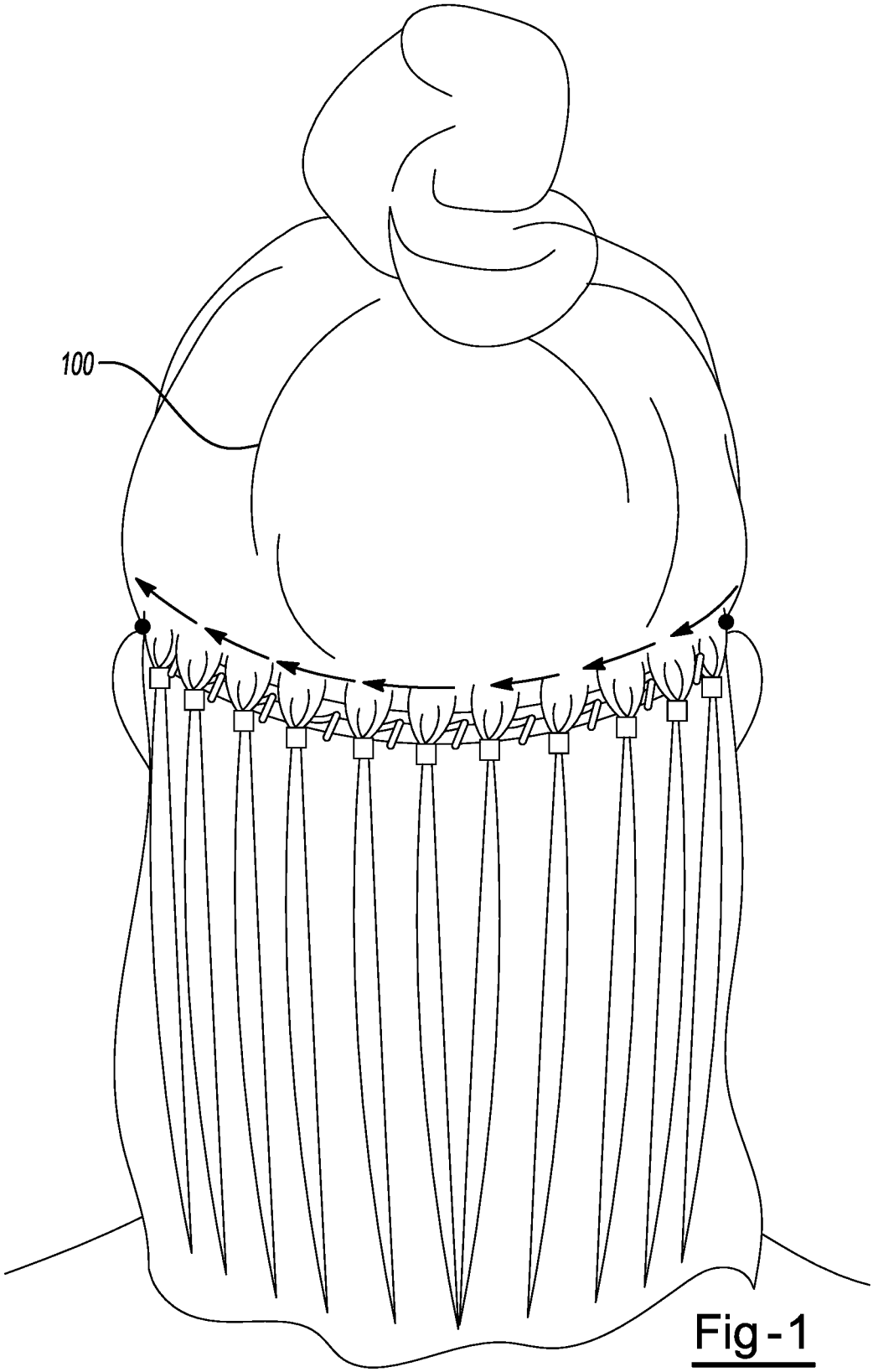
Fig-1 PRIOR ART
FIG. 1 depicts the prior art stitching method according to one or more embodiments shown and described herein.
Figure 2:
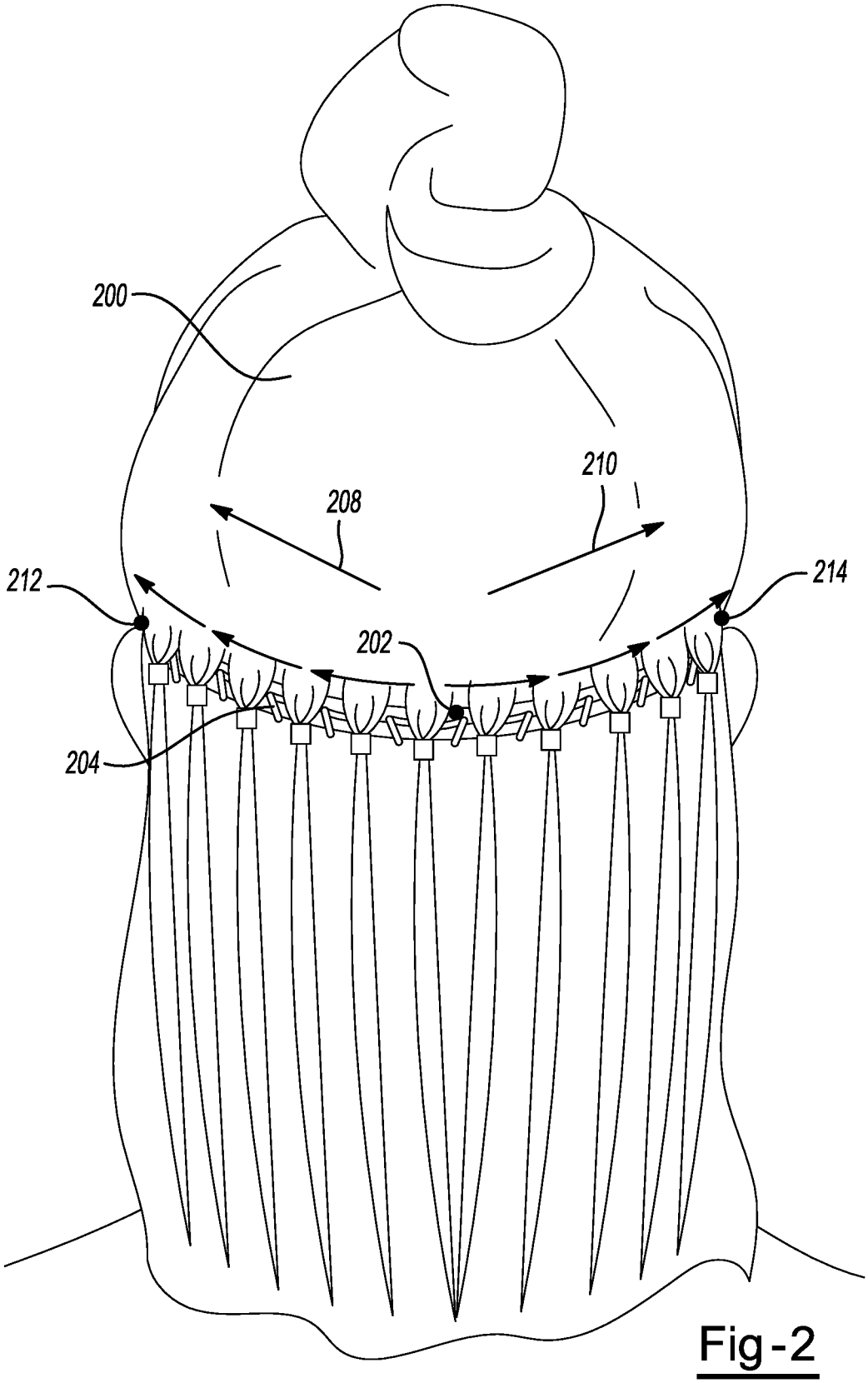
FIG. 2 depicts an improved split stitching method according to one or more embodiments shown and described herein.

The present system as disclosed herein provides for a method of installing hair extensions that alleviates prior known disadvantages of lifting, sores, bald spots . . . etc. The method of the present invention, as illustrated in FIG. 2, shows a user's head 200. The user's head 200 is covered in hair allowing the hair to be sectioned off, and for the extension artist to stitch a hair extension weft 204 thereto. Each weft includes a base with hair strands extending therefrom. In this embodiment as shown in the Figures, the artist begins stitching in the back center (or other starting point) of the user's head rather than the side at the end of the weft. Alternatively, the artist may start stitching at any location along the weft (not just the center) so long as it is spaced apart from the end of the weft. The hair on the back of the user's scalp is thicker (and thus more hair for the artist to stitch into), less sensitive (making the stitching more comfortable to the user), and stronger (making the hair less likely to break off and cause bald spots). The artist then begins stitching from the back of the head towards the face of the user.

Stitching begins at the center point (or starting point) 202, as illustrated in FIG. 2. It should be appreciated that the center point 202 may be any starting location along the weft so long as the starting point is spaced apart from the free end of the weft, otherwise the weft may lift. The artist then begins stitching the weft in a first direction 208 towards a first end point 212. Once the first weft section installation is complete, the artist begins on the second weft section installation. The artist begins again at the starting point 202 and begins stitching in a second direction 210 towards a second end point 214.

In general, the method includes the steps of:

- sectioning the user's hair to provide a guide to the artist (into a horseshoe or other similar shape);
- positioning the weft along the part;
- placing beads on sections of hair;
- locating any middle portion spaced at least slightly apart from the end of the user's head (or alternatively cutting the weft into sections);
- starting a first stitching section and moving towards the user's face; and
- starting a second stitching section at the same location as the first and moving toward the other side of the user's face.

The benefits of the method and pattern as described herein include balancing the tension on either side of client's head, relieving the tension on the side of the head where the anchor knot was, and the absence of the lifting of the wefts on either side upon grow out. Further, both sides of the weft lay completely flat to the client's head. There are no tension sores for client, no bald spots, and no stress on the finer hairs by the face to the wearer of the hair extensions. If starting at a distal end of the weft, these advantages are impossible to achieve.

Other embodiments include the following. A weft hair extension installation method on a user, the method including the steps of sectioning the user's hair to form a part, positioning the weft along the part, securing beads on sections of hair to secure the weft to the user's hair, locating a middle portion spaced at least slightly apart from the end of the weft at the back of the user's head, the middle portion being any position located between the distal ends of the weft, starting a first stitching section beginning at the back of the head and moving towards the user's face, and starting a second stitching section at the same location as the first and moving toward the other side of the user's face, wherein by starting at a middle portion reduces lifting of the weft on user, reduces sore spots, and creates an increased connection of the weft to the user's hair. In some embodiments, the weft lays flat where the stitching ends. In other embodiments, the beads are made from silicone or other similar material. In some embodiments, the thread is made of cotton, cotton blend, polyester, polyester blend, plastic, plastic-like, or other similar material. In other embodiments, the stitching section uses the thickest and least sensitive hair from the back of the head.

A weft hair extension installation method as shown and described herein including the steps of locating any middle portion of the user's head after the hair is parted and a weft is placed, starting a first stitching section from the back of the user's head and moving towards their face, and starting a second stitching section at the same location as the first and moving towards the other side of the of the user's face.

A weft hair extension installation method on a user, the method including the steps of sectioning the user's hair to form a part, positioning the weft along the part, securing beads on sections of hair to secure the weft to the user's hair, cutting the weft into sections, sewing each weft to the user's head starting at a position located farthest from the user's face, starting a first stitching section beginning at the back of the head and moving towards the user's face, and starting a second stitching section at the same location as the first and moving toward the other side of the user's face wherein by starting at a middle portion reduces lifting of the weft on user, reduces sore spots, and creates an increased connection of the weft to the user's hair.

Further, this method allows the artist to use a single piece of thread for weaving. When starting at any location spaced apart from the end pieces, only one knot is required on using a single piece of thread. Alternatively, multiple pieces of thread may be utilized.

The foregoing descriptions of specific embodiments of the invention have been presented for purposes of illustration and description. They are not intended to be exhaustive or to limit the invention to the precise forms disclosed, and modifications and variations are possible in view of the above teaching. The exemplary embodiments were chosen and described to best explain the principles of the invention and its practical application, to thereby enable others skilled in the art to best utilize the invention and its embodiments with modifications as suited to the use contemplated.

With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the invention. It is noted that the terms "substantially" and "about" may be utilized herein to represent the inherent degree of uncertainty that may be attributed to any quantitative comparison, value, measurement, or other representation. Any values that may be modified by such terminology are also part of the teachings herein. For example, if a teaching recited "about 10," the skilled person should recognize that the value of 10 is also contemplated.

In this embodiment, the user will always end with 2 end knots. Accordingly, 3-4 knots are needed for the method in total. The anchor knot or knots (if the installer chooses to use a separate thread) and 2 end knots that include no back stitching or over-direction of the thread. In prior methods, a single anchor know is used between the first and second end bead. The installer then stitches toward the face toward the end of the weft and then continue the same thread overdirecting it all the way around stitching around the head to the left and end with 1 end knot.

The method and system of the present specification offers several advantages. The system includes balanced tension on the users hair and scalp upon initial install, and in the grow-out phase which alleviates the most common issue with extensions not being installed properly (e.g. bald spots due to tension on the hair/scalp). The current method as disclosed herein has a much faster installation time for the artist since they are working with half the amount of thread since they are stitching half the head at a time. Further, the corners of the wefts lay flat and comfortable and remain discreet for the client.

These terms are also utilized herein to represent the degree by which a quantitative representation may vary from a stated reference without resulting in a change in the basic function of the subject matter at issue.

As used herein, unless otherwise stated, the teachings envision that any member of a genus (list) may be excluded from the genus; and/or any member of a Markush grouping may be excluded from the grouping.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consist of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps. All references herein to elements or metals belonging to a certain Group refer to the Periodic Table of the Elements published and copyrighted by CRC Press, Inc., 1989. Any reference to the Group or Groups shall be to the Group or Groups as reflected in this Periodic Table of the Elements using the IUPAC system for numbering groups.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination.

It is therefore intended that the appended claims (and/or any future claims filed in any corresponding application) cover all such changes and modifications that are within the scope of the claimed subject matter.

What is claimed is:

1. A weft hair extension installation method on a user, the method comprising steps of:

sectioning a user's hair to form a part;

positioning a weft along the part;

securing beads on sections of the user's hair;

locating a middle portion of a user's head spaced at least slightly apart from an end of the weft and positioned at a back of the user's head, the middle portion being any position located between distal ends of the weft;

coupling the weft to the user's hair at the middle portion of the user's head by using a thread to tie a knot around the weft and the user's hair;

stitching a first stitching section using the thread beginning at the knot at the back of the user's head and moving towards a side of user's face; and stitching a second stitching section using the thread beginning at the same location as the first stitching section and moving towards opposite the side of the user's face;

wherein starting at the middle portion reduces lifting of the weft relative to the user's hair, reduces sore spots, and improves balance of the weft to the user's hair;

wherein the stitching of the first stitching section mirrors the stitching of the second stitching section.

2. The hair extension installation method according to claim 1, wherein the weft lays flat at the distal ends of the weft.

3. The hair extension installation method according to claim 1, wherein the beads are made from silicone or other similar material.

4. The hair extension installation method according to claim 1, wherein the thread is made of cotton, cotton blend, polyester, polyester blend, plastic, plastic-like, or other similar material.

5. The hair extension method according to claim 1, wherein the first stitching section and the second stitching section uses a thickest portion of the user's hair from the back of the user's head.

6. A weft hair extension installation method as shown and described herein comprising:

locating a middle portion of a user's head after a user's hair is parted and a weft is placed, the middle portion being any position located between distal ends of the weft at a back of the user's head;

coupling the weft to the user's hair at the middle portion of the user's head by using a thread to tie a knot around the weft and the user's hair;

stitching a first stitching section using the thread beginning from the knot at the back of the user's head and moving towards a side of user's face; and stitching a second stitching section using the thread beginning at the same location as the first stitching section and moving towards opposite the side of the of the user's face;

wherein the stitching of the first stitching section mirrors the stitching of the second stitching section.

* * * * *